US005209382A

United States Patent [19]

Chang

[11] Patent Number: 5,209,382

[45] Date of Patent: May 11, 1993

[54] GARMENT HANGER FOR NECKTIES WITH SUPPORTING RODS AND SNAP LEAF CLIP

[76] Inventor: Ching-Chao Chang, No. 202-1, Tachou Rd., Shen Kang Village, Taichung County, Taiwan

[21] Appl. No.: 967,423

[22] Filed: Oct. 28, 1992

[51] Int. Cl.[5] ..... A47G 25/74

[52] U.S. Cl. ..... 223/85; 223/DIG. 1; 211/89; 211/87

[58] Field of Search ..... 223/85, DIG. 1, DIG. 2, 223/DIG. 3, DIG. 4; 211/87, 89, 105.1; 248/316.7; 40/657; D6/327

[56] References Cited

U.S. PATENT DOCUMENTS

| | | | |
|---|---|---|---|
| 1,687,129 | 10/1928 | Henniger | 211/89 |
| 2,026,746 | 1/1936 | Moore | 211/89 |
| 2,860,788 | 11/1958 | Hardman | 211/89 |
| 3,880,290 | 4/1975 | Hughes | 211/89 |
| 4,863,043 | 9/1989 | Bower | 223/DIG. 1 |
| 4,958,738 | 9/1990 | Lee | 223/96 |
| 5,109,993 | 5/1992 | Hutchinson | 211/87 |

FOREIGN PATENT DOCUMENTS

| | | | |
|---|---|---|---|
| 36971 | 6/1967 | Finland | 211/87 |
| 1555703 | 12/1968 | France | 211/89 |
| 425499 | 3/1935 | United Kingdom | 211/87 |

*Primary Examiner*—Clifford D. Crowder
*Assistant Examiner*—Bibhu Mohanty
*Attorney, Agent, or Firm*—Bacon & Thomas

[57] ABSTRACT

An improved structure of necktie hanger consists of a seat board with mortises, a plurality of short rods with tenons, and a plurality of snap leaves with holes. After the tenons insert through the holes, the seatboard and rods can be tenon-and-mortise jointed. Then neckties can be easily hung on the hanger and clamped by the snap leaves but not easy to slip down sideways.

4 Claims, 4 Drawing Sheets

GARMENT HANGER FOR NECKTIES WITH SUPPORTING RODS AND SNAP LEAF CLIP

FIELD OF THE INVENTION

This invention relates to a structure of necktie hanger, particularly to a necktie hanger which can easily and effectively clamp neckties.

BACKGROUND OF THE INVENTION

The conventional type of necktie hanger provides a plurality of hanging rods only with big round heads to keep the neckties from slipping down. This may prevent the necktie from dropping through the big round heads, but the necktie will slip down from either side of the rod when the center of gravity of the necktie is not exactly put on the rod.

SUMMARY OF INVENTION

The inventor's motive for the present invention is that nowadays it is very important for gentlemen to keep or store their neckties because they have many neckties in different colors for different seasons and occasions. The main object of the invention is to provide an improved structure of necktie hanger which can easily and effectively clamp and locate a plurality of neckties. Another object of the invention is to provide an improved structure of necktie hanger which can securely fix neckties on the hanging rods and can prevent them from slipping down.

In short, the improved structure of necktie hanger is comprised of a seat board with mortises, a plurality of short rods with tenons, and a plurality of snap leaves with holes. After the tenons insert through the holes, the seatboard and rods can be tenon-and-mortise jointed. Then neckties can be easily hung on the hanger and clamped by the snap leaves but not easy to slip down sideways.

DESCRIPTION OF THE PREFERRED EMBODIMENT

Figure 1:
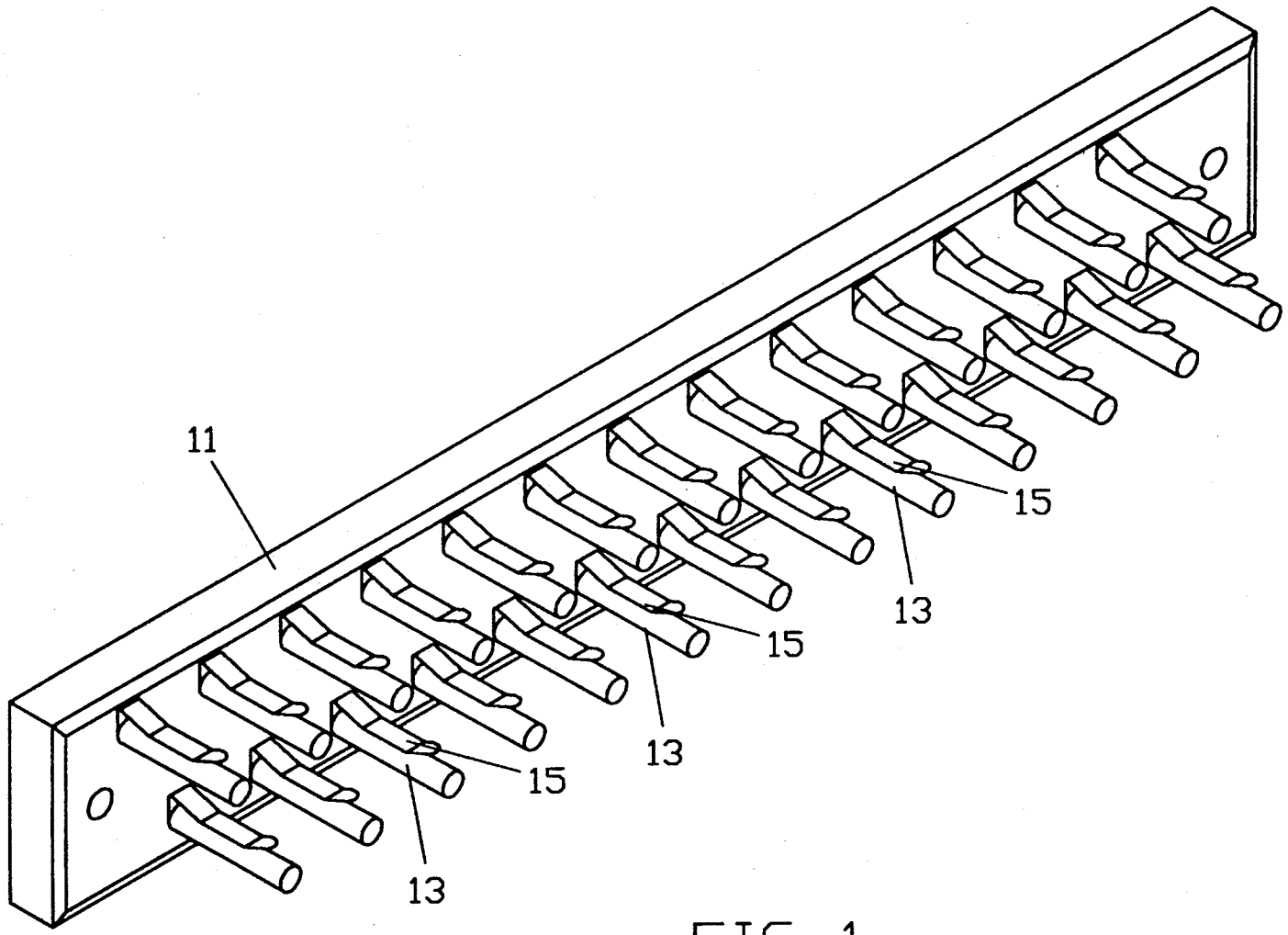
FIG. 1 is a perspective view of the invention.

As shown in FIG. 1, the improved structure of necktie hanger consists of a seat board (11) and a plurality of hanging rods (13) and snap leaf (15). By means of the snap leaf (15), a necktie can be clamped on the hanging rod (13) and will not slip down too easily.

Figure 2:
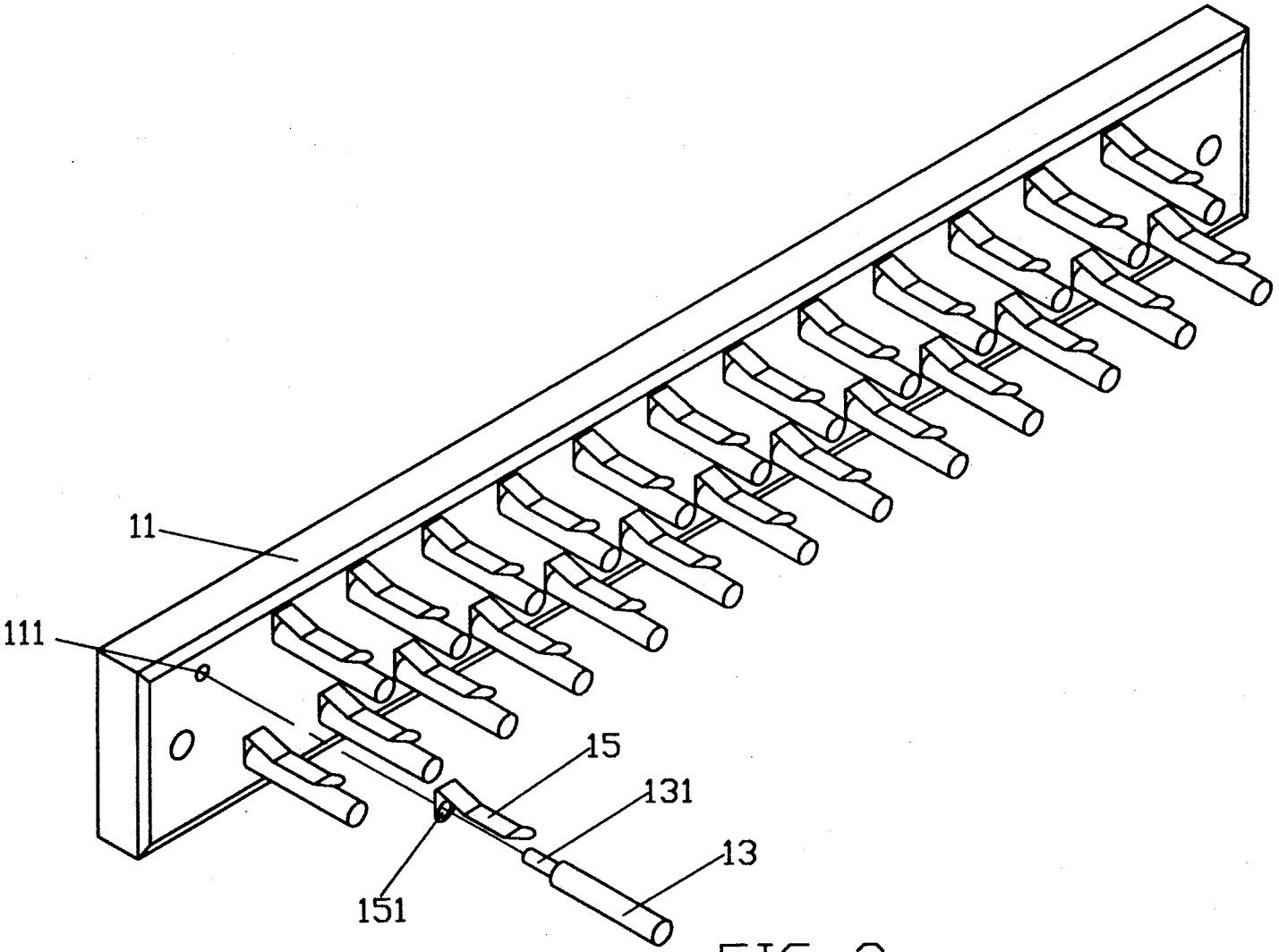
FIG. 2 is a sectional view of the first preferred embodiment of the invention.

As shown in FIG. 2, the seat board is shaped like a rectangular block. It provides a plurality of mortises (111) for hanging rods (13) to insert into them.

The hanging rod (13) shaped like a round rod. One end of the rod (13) has a convex tenon (131). The tenon (131) can insert through a snap leaf (15) and into the mortise (111) of the seat board (11). This is a kind of tenon and mortise joint.

Figure 3:
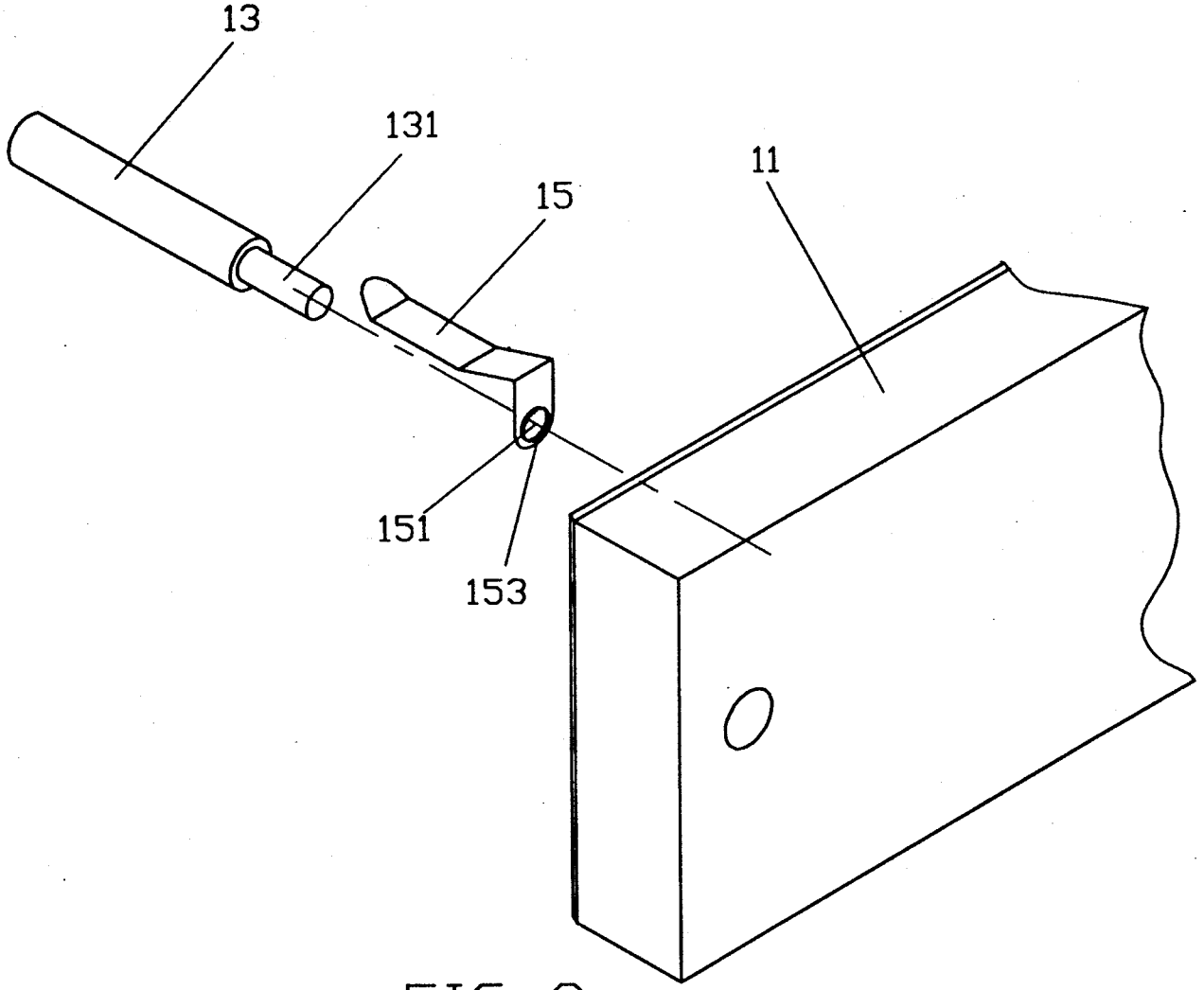
FIG. 3 is a sectional view of the second preferred embodiment of the invention.

The snap leaf (15) shaped like an "L" has a upper leg and a short lower leg and can be made of elastic metal or plastics. The snap leaf (15) and the hanging rod (13) can be made of plastics and injection-molded into an integrity. The short lower portion of the "L" shaped snap leaf (15) has a hole (151) for the convex tenon (131) to insert into it so that it can be fixed on the tenon (131) or between the seat board (11) and the shoulder of the hanging rod (13). Or there disposed a plurality of scarfing teeth (153) (shaped like saw teeth) on the inner wall of the hole (151), as shown in FIG. 3. When the covex tenon (131) inserts into the hole (151), the scarfing teeth (153) will scarf tightly around the tenon (131). The teeth (153) can reinforce the steadiness of the snap leaf (15) and the joint between tenon (131) and mortise (111).

Figure 4:
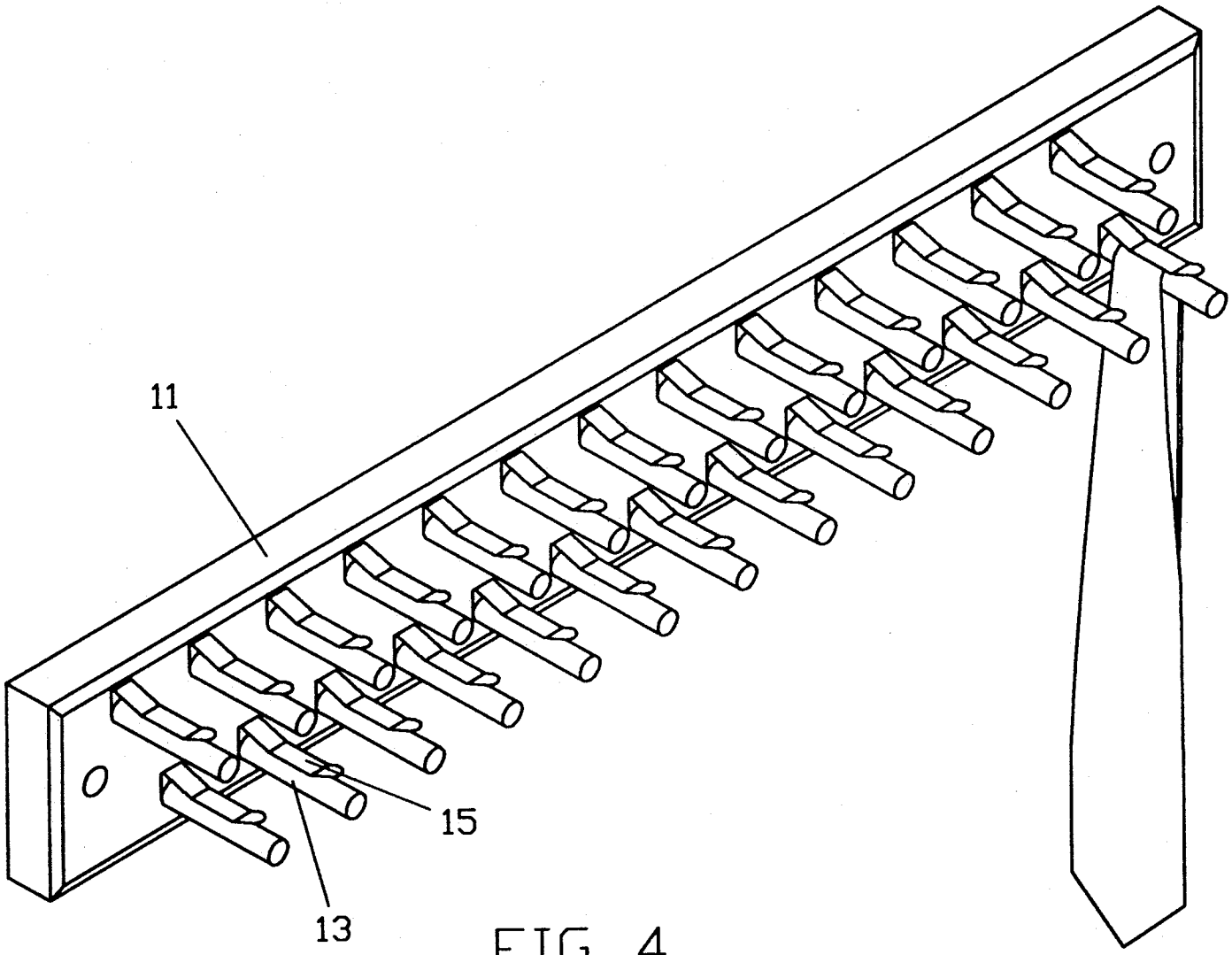
FIG. 4 is a schematic diagram showing a necktie hanged on the invention.

As shown in FIG. 4, when the present invention is put in use, clamp the necktie between the hanging rod (13) and snap leaf (15). Due to the elasticity of the snap leave (15), the necktie will be fixed on the hanging rod (13). By this way, the necktie can be easily hung on the hanger, but not easy to slip down.

What is claimed is:

1. A necktie hanger comprising: a rectangular shaped set board having a plurality of mortises, a plurality of tenons to be used as supporting rods, and a plurality of L-shaped snap leafs each having a lower leg with a round hole therein, each tenon being inserted through the round hole and into a mortise in the seat board to provide a supporting rod to suspend a necktie, each snap leaf having an upper leg extending substantially parallel to said tenons to form a clip to retain the necktie.

2. The necktie hanger claimed in claim 1 wherein each hole in the snap leaf has a plurality of scarfing teeth for reinforcing the snap leaf to the tenon.

3. The necktie hanger of claim 1, wherein the snap leaf is made of elastic metal.

4. The necktie hanger of claim 1, wherein the snap leaf is made of plastic.

* * * * *